US006062173A

United States Patent [19]

Heinrichs

[11] Patent Number: 6,062,173

[45] Date of Patent: May 16, 2000

[54] UPPER BODY HARNESS SYSTEM

[76] Inventor: Stephen C. Heinrichs, P.O. Box 132, Clayton, Ohio 45315

[21] Appl. No.: 09/123,248

[22] Filed: Jul. 27, 1998

[51] Int. Cl.[7] ..... A62B 35/00

[52] U.S. Cl. ..... 119/770; 119/907

[58] Field of Search ..... 119/770, 857, 119/907; 224/184, 185, 158, 159, 160; 434/254, 255

[56] References Cited

U.S. PATENT DOCUMENTS

| | | | |
|---|---|---|---|
| 602,861 | 4/1898 | Lyon | 119/770 |
| 1,760,443 | 5/1930 | Scheidegger | 224/160 |
| 2,407,714 | 9/1946 | Maloney | 224/160 |
| 2,812,010 | 11/1957 | Abdallah | 482/69 |
| 2,871,915 | 2/1959 | Hogan | 482/69 |
| 2,956,541 | 11/1960 | Rall | 434/254 |
| 3,721,437 | 3/1973 | Skaricic | 482/43 |
| 4,545,575 | 10/1985 | Forjot | 482/68 |
| 5,101,768 | 4/1992 | Cates | 119/770 |
| 5,242,380 | 9/1993 | Steinbrueck | 602/32 |
| 5,351,654 | 10/1994 | Fuentes | 119/770 |
| 5,540,188 | 7/1996 | Heinrichs | 119/770 |

OTHER PUBLICATIONS

Balance Harness, (16 pg. booklet, Copyright 1996).

Functional Rehab System, (16 pg. booklet, mistakenly marked Copyright 1996—Actual Dec. 9, 1997).

Functional Rehab System—(16 pg. booklet, Copyright 1998).

*Primary Examiner*—Peter M. Poon
*Assistant Examiner*—Judith A. Nelson
*Attorney, Agent, or Firm*—William Weigl

[57] ABSTRACT

An upper body supporting system comprising a pair of loops surrounding the thoracic area and axilla is provided with adjustable suspension e.g., a loop means for controllably supporting the person from above and a cinching member or members to enable the harness to avoid contact thereof with the face and head of the person being supported by the harness.

15 Claims, 5 Drawing Sheets

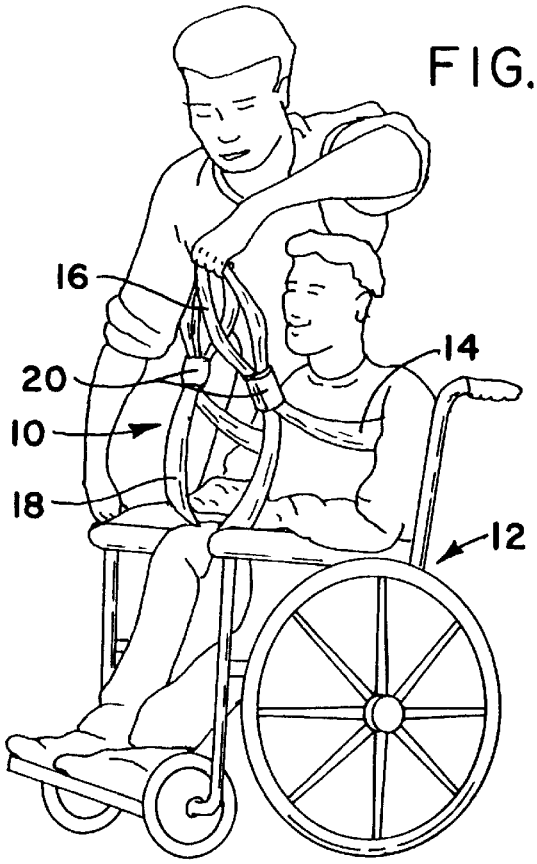
FIG. 1
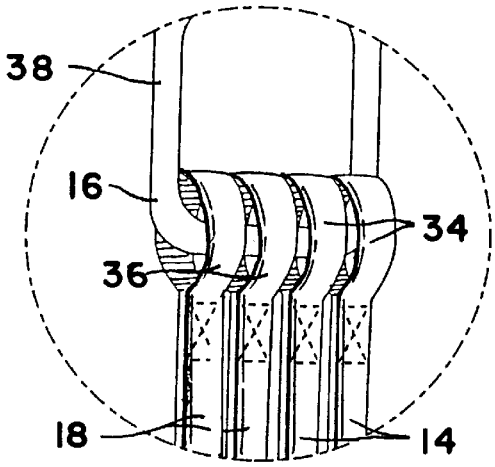
FIG. 5
FIG. 4
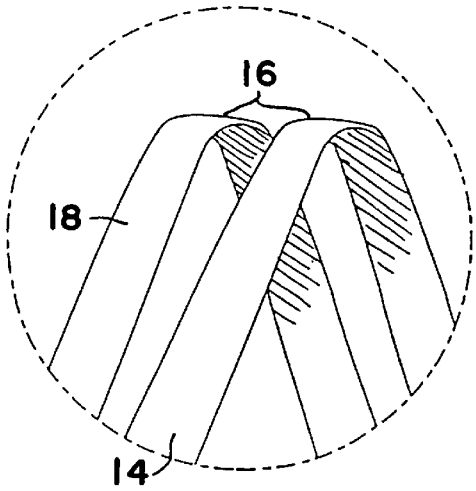
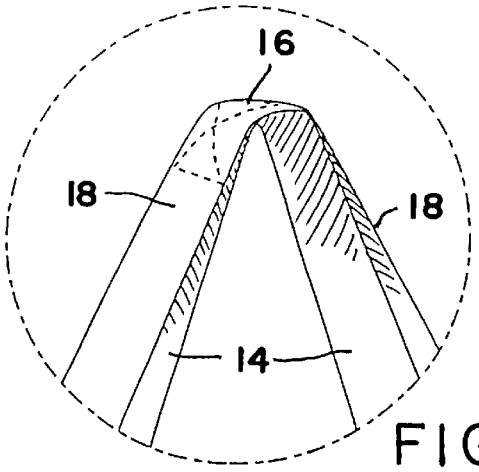
FIG. 6

UPPER BODY HARNESS SYSTEM

This invention relates to a body harness intended for use primarily in personal rehabilitation such as when assisting a person in relearning to walk or do simple exercises after suffering from a stroke or other disability resulting in mobility loss. The invention also has usefulness in helping infants learn to walk for the first time, in assisting young children to learn to ride a bicycle without using training wheels, extricating individuals vertically from a precarious situation and still other uses where either full or only partial body support is required.

BACKGROUND OF THE INVENTION

The improvements of this invention are an outgrowth of the device illustrated in my U.S. Pat. No. 5,540,188 granted Jul. 30, 1996 and entitled TODDLER HARNESS. To the extent that there are similarities between the device of my '188 patent and the subject matter disclosed in this application, the disclosure of my '188 patent in incorporated herein by reference. As shown in the '188 patent, a pair of interconnected looped straps were placed about a child's back, chest and beneath the arms so that an adult could assist the child in staying upright when learning to ride a bicycle. In essence, the straps were a totally different substitute for conventional "training wheels". The amount of adult support from the top of the looped straps was readily controllable, according to the support needs of the child. At the outset, before beginning to pedal the bike, the adult would almost completely support the child. By then walking or jogging alongside and still holding the straps above the child, the amount of support could be decreased as the adult could feel that the child was beginning to balance properly. At some point in time where the adult was confident that support was no longer needed, the straps could be maintained in place awhile longer without support being supplied, to assure that the child was protected against a fall.

When it was recognized that the invention of the '188 patent had other potential uses, it was sought to adapt it to adult use. In particular, an effort was made to adapt it to a person who had loss of mobility due to lower extremity amputation, stroke or other disability. While little difficulty was experienced in providing a harness of sufficient strength and having sufficient padding for comfortably supporting a large adult, the harness according to my '188 patent usually contacted opposite sides of the person's face and head. This not only caused physical discomfort, but also tended toward distraction and loss of concentration due to rubbing against the person's head and face as he or she moved. This problem was of little or no significance for a toddler learning to ride a bicycle, particularly since the toddler typically had a helmet keeping the straps away from his or her face. However, the problem had the potential of rendering the device of my '188 patent of little or only nominal value in rehabilitation.

SUMMARY OF THE INVENTION

The improvements of this invention were designed to eliminate the aforementioned facial and head contact problem, thus freeing the individual undergoing rehabilitation to focus on the essentials of relearning to walk or performing other tasks. A stroke victim or a leg amputee with an artificial prosthesis can thus concentrate on foot and leg placement and maintaining balance without the distraction of straps contacting the sides of the head and face. The improvement of this invention lies in the technique and apparatus for gathering the upper ends of the harness above the nape of the neck and behind the person's head, essentially vertically aligned with the person's spinal column. In so doing, the person can be maintained upright for walking, thus avoiding and tendency to pitch forwardly or fall backwardly.

A principal object of the invention is to provide a harness for at least partially supporting an individual by the thoracic area from above, without any portion of the harness contacting the individual's face or head.

Another object of the invention is to provide in conjunction with such a harness an adjustable hoist mechanism which allows the individual or a therapist assisting the individual to vary the degree of support provided by the harness, such hoist mechanism being capable of relieving support completely and serving solely to protect against a fall whenever the harness is being used by a person who is almost free to walk without support.

Another object is to provide different variations of the harness construction and of the means for gathering the upper ends of each different variation behind the person's head, essentially vertically aligned with the spinal column.

A further object is to provide a simple, inexpensive harness construction for achieving the foregoing objects, and to provide simple and inexpensive cinching means and techniques for gathering free ends of loops of the harness straps into a suspension position.

Other objects and advantages will become apparent from the following description, in which reference is made to the accompanying drawings.

BRIEF DESCRIPTION OF THE DRAWINGS

FIG. 1 is an artist's rendering of an assistant applying a preferred form of body harness of the invention to the thoracic area of a wheelchair-bound person.

FIGS. 4–6 illustrate the harness appearance of three different variations of the suspension system at the upper end thereof.

DESCRIPTION OF THE PREFERRED EMBODIMENTS

The description of the invention will focus on a body harness 10 that is employed in the rehabilitation of a mobility-impaired individual such as one who has had a leg fracture, spinal injury, nerve damage, stroke, amputation or other problem ordinarily requiring the assistance of another in getting back onto his or her feet to recommence mobility. It should be understood that other uses of the harness are available also, such as extricating someone from a river or side of a mountain by means of a helicopter, and to the extent that the claimed structure is capable of being utilized for such a purpose, it is considered to be within the scope of my invention. Other uses will become apparent from the following description for rehabilitation purposes.

Figure 2:
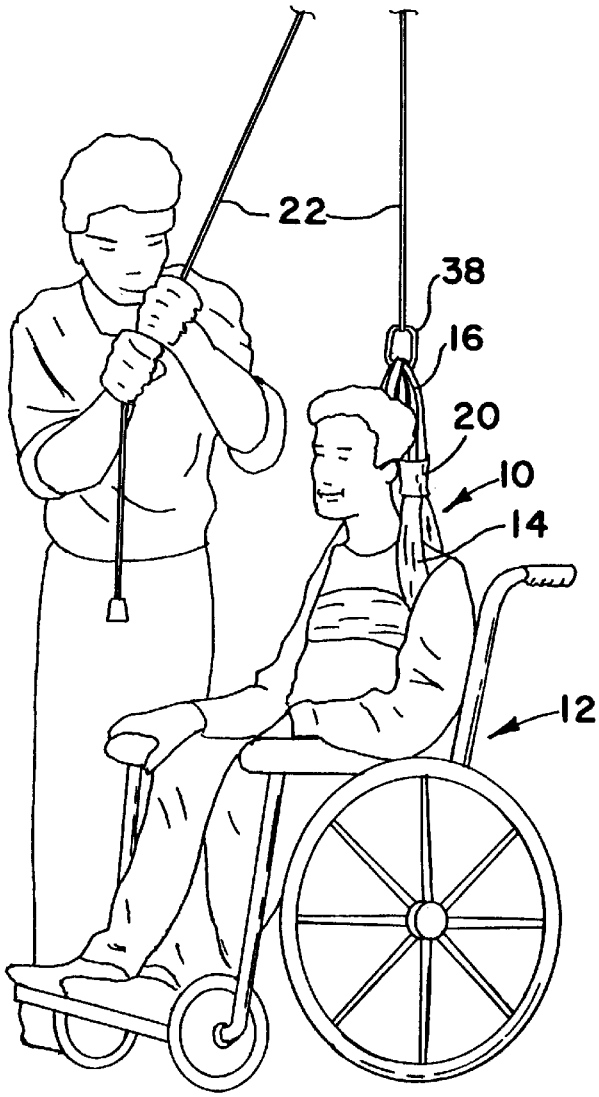
FIG. 2 is a view of the assistant of FIG. 1 beginning to support some of the weight of the person to help him begin to rise from the wheelchair after the harness has been fully applied.

A male patient seated in a wheelchair 12 is attended by an assistant, usually a therapist. The therapist is shown applying the harness around the patient's thoracic area, i.e., the chest and back. As seen in FIG. 1, a back strap or loop 14 has already been placed around the shoulder blades at the back, typically by having the patient first raise his arms over his head and place them through the loop 14. At that time, the therapist will position the remainder of the harness 10 forwardly of the patient, while holding it by a suspension means 16 at the upper end of the harness. The suspension means can be part of the back strap 14 and a chest strap or loop 18 or can be any of several different constructions which are illustrated in FIGS. 4 through 7. As shown in FIG. 1, two cinching members 20 combine the loops 14 and 18 into a unitary harness toward the upper end of the suspension means 16. With the harness 10 held in the position shown, the patient then puts his hands and arms forwardly through the loop 18. The therapist then locates the loop 18 snuggly around the chest and draws the rest of the loop 18 beneath the axilla or armpits on both sides of the patient. What has now been accomplished is to have the back loop 14 firmly against the shoulder blades, forwardly of the armpits and slightly backwardly around the shoulders, and the chest loop 18 across the chest and extending backwardly beneath the armpits and then upwardly. Through manipulation of the suspension means 16, the loops 14 and 18 are adjusted to locate the suspension means in a suspension position above the person's body and generally biomechanically aligned with the person's spine as shown in FIG. 2. At that time, the cinching members 20 are slid downwardly as far as possible above the shoulders without adversely affecting the patient's comfort. The patient is now ready to be supported to the extent necessary by a mechanical advantage means 21 from a cable or rope 22.

A key feature of my invention is the structure that enables the straps of the harness to be directed away from the side of the person's head or face while in supporting position. The preferred and most inexpensive form of cinching members 20 is to utilize simple tubing cut to appropriate lengths. Various kinds of strap connectors or clamps, either removable or non-removable relative to the harness, may be used in place of the tubes. As will be seen in the version of harness shown in FIG. 3, the two tubular cinching members 20 are located intermediate the patient and a main cinching member 24, to collect the upper portion of the suspension means 16 into a gathering.

A male patient has been shown in the drawings. As such, the portion of the chest strap around the chest can be as high or as low as is comfortable for the person. For an adult female, obviously the portion around the front of the chest would be located at a height which provides most comfort to the individual. This can be done with minimal discomfort to a female. The therapist should also make certain that the sections of the two loops 14 and 18 beneath the armpits are comfortably positioned. This can all be accomplished at the time when the harness is drawn up and gathered behind the person's neck.

Once the person has been partially supported, he can begin to assist himself in tranferring from the chair 12, or if that is not possible, the person's entire weight can be supported. Since therapy is normally not started until the patient is at least able to partially support himself, it can be expected that full weight would not need to be supported by the cable 22 at this stage.

Figure 8:
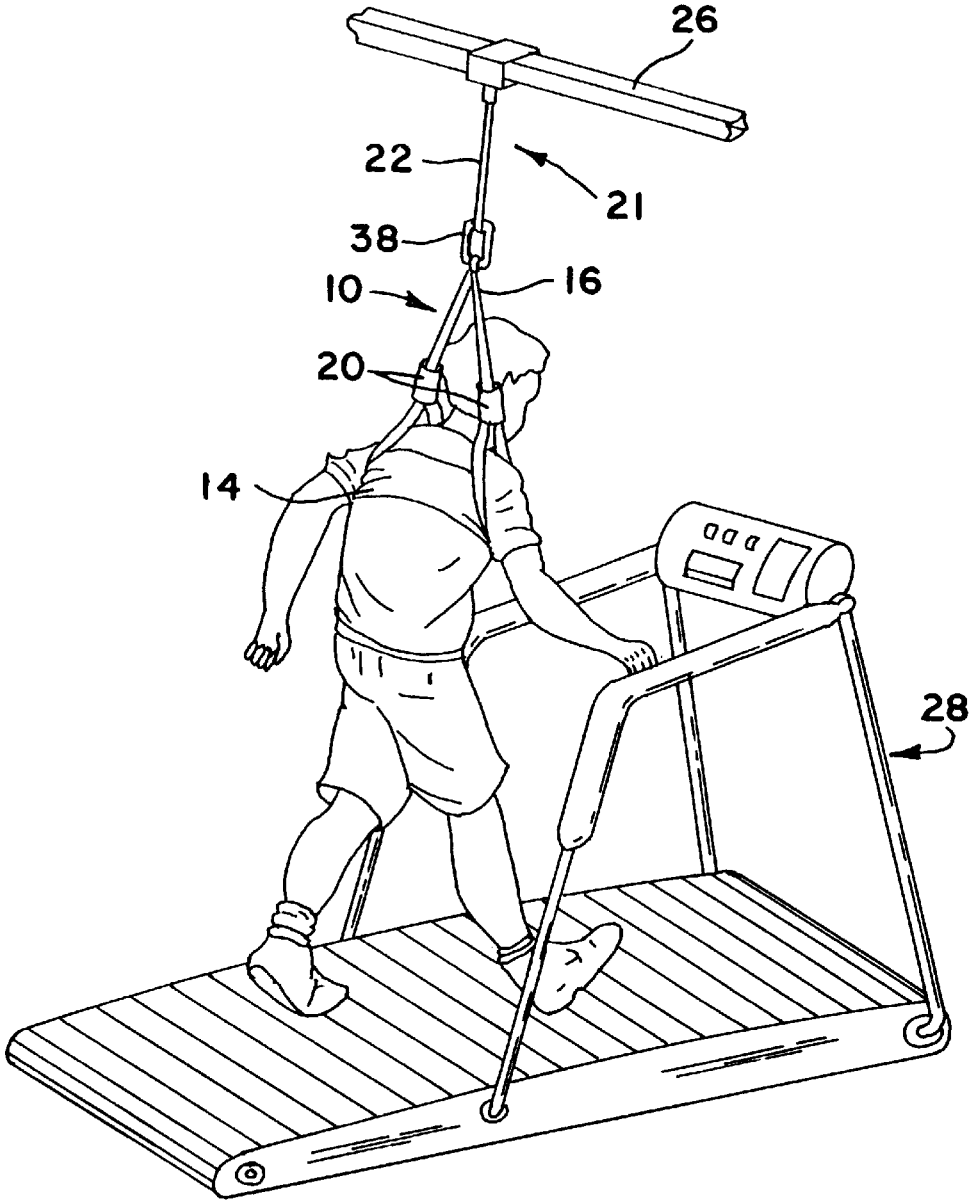
FIG. 8 is an artist's rendering of a body harness-supported individual walking on a treadmill, this depiction being one in which nominal support is provided, such as protection against a fall.

The person must be supported from above during use of the harness 10. FIG. 8 shows the person supported by a cable from a rail 26 while walking on a treadmill 28. The rail would obviously be supplied with a conventional hoisting mechanism so as to determine the amount of support required. Obviously, use of a treadmill would occur at a late stage of rehabilitation, when the patient was becoming capable of almost complete support of himself. At such time, the amount of support can be almost non-existent. The use of the harness would then be primarily for preventing a fall in case the patient lost his balance or could not maintain the treadmill surface speed. The rail 26 would be customarily supported by a couple of upright beams supported from a base surface such as a floor.

Figure 9:
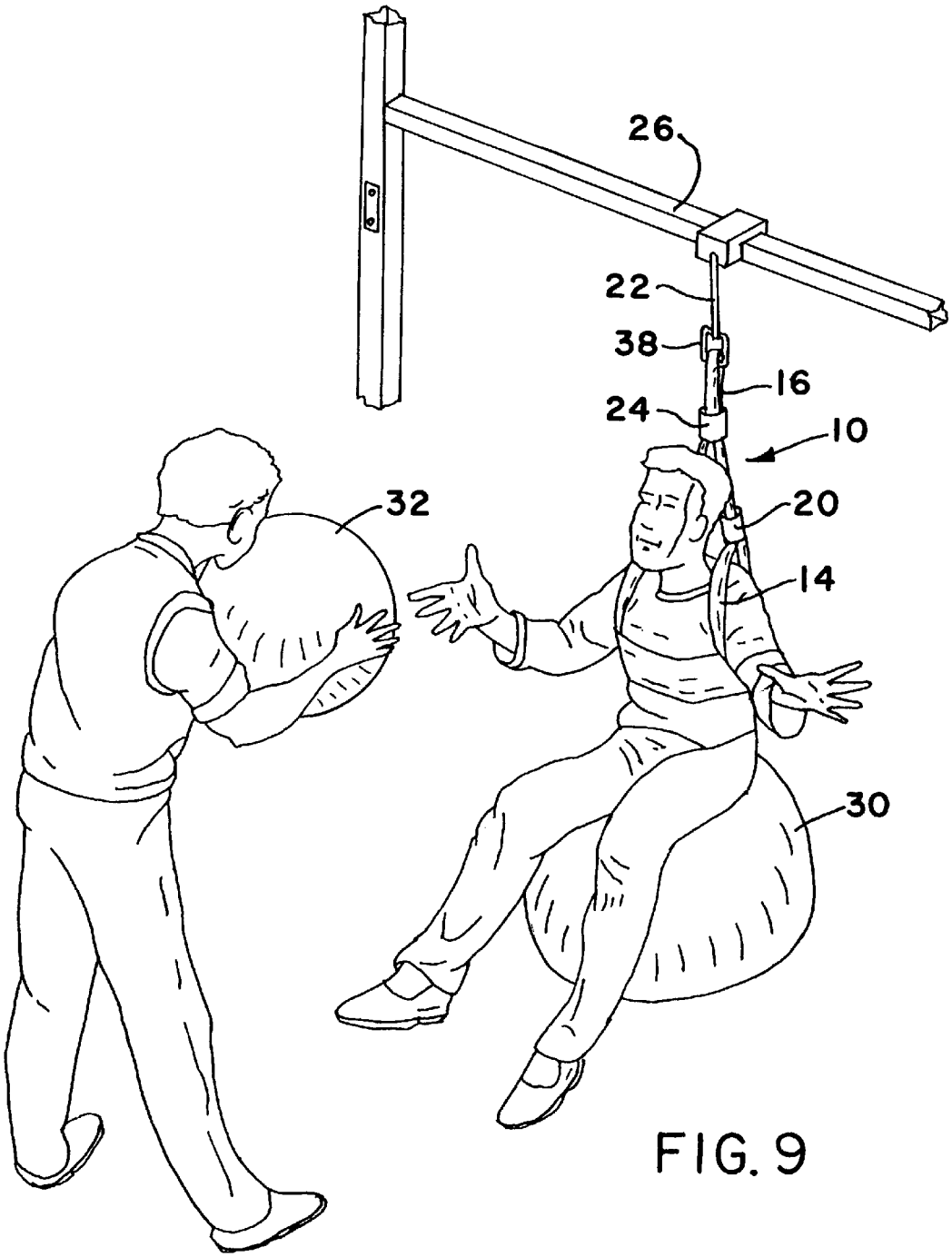
FIG. 9 is a view of a supported person undergoing exercise rehabilitation while supported from a body harness suspended from an overhead rail.

FIG. 9 illustrates a therapist in an exercise routine with a patient. Here, the patient is seated on a therapy ball 30 while a medicine ball 32 is being passed back and forth between the therapist and the patient. Again, like with the treadmill situation, this type of therapy would occur at a late stage in the rehabilitation when the primary function of the harness 10 is to lightly support the individual to prevent toppling if he is unable to handle the ball. It can also be seen from FIG. 9 that the cable can just as easily provide full support for a person being extricated from water by helicopter.

Referring now to FIGS. 3 through 7, the structure of various forms of the harness 10 will be described. Padding (not shown) is typically provided internally or externally of the straps to assure patient comfort, particularly for those situations where substantial weight must be supported, such as at the outset of therapy when a large portion of the patient's weight must be held in suspension. This is discussed in my foregoing '188 patent, which is incorporated herein. As the desire or need for padding is not an essential part of the improvements of this invention, let it suffice to say that padding is desirable and is preferably incorporated.

Figure 3:
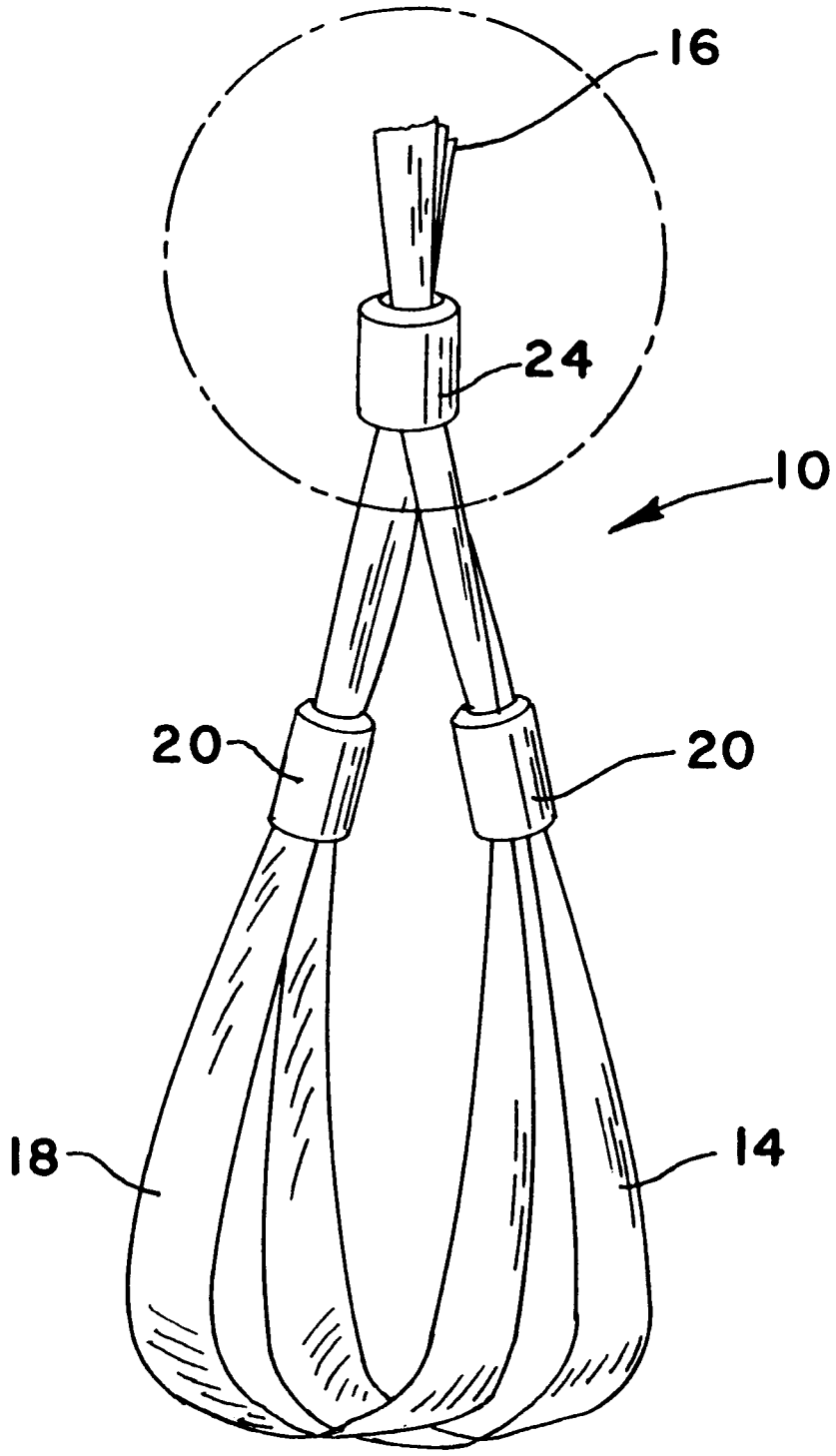
FIG. 3 is an assembly view of a preferred form of freely suspended harness with its cinching means.

The enlarged view of the harness 10 in FIG. 3 shows essentially structure like that described in connection with FIGS. 1, 2 and 8, with the main cinching member 24 being added just below the suspension means 16. FIG. 3 also shows the two intermediate cinching members 20 that gather the loops 14 and 18 close to the shoulders of the individual. The main cinching member 24 is used to draw or gather the sections of the loops above the cinching members 20 to a central location over the spinal column of the patient. This final or upper gathering brings the upper portions of the loops 14 and 18 together as a single suspension point at the uppermost end of the suspension means 16. FIGS. 4–6 show several variations of suspension means 16. In FIG. 4, the two loops 14 and 18 are of the same circumferential dimension and are sewn or otherwise fastened at the top end. In FIG. 5, the loops are each an elongated strap, both having the same length. The opposite ends of each strap 14 and 18 in FIG. 5 are provided with small loops 34 and 36 respectively. These small loops are placed over a connecting ring 38 that can be attached to the cable 22. In the latter design, the cinching members 20 and 24 are usually in position on the harness at all times. In the designs of FIGS. 4 and 6, the cinching members 20 are typically in place, but the cinching member 24 can be separate from the harness 10 and be used or not, as desired.

Figure 7:
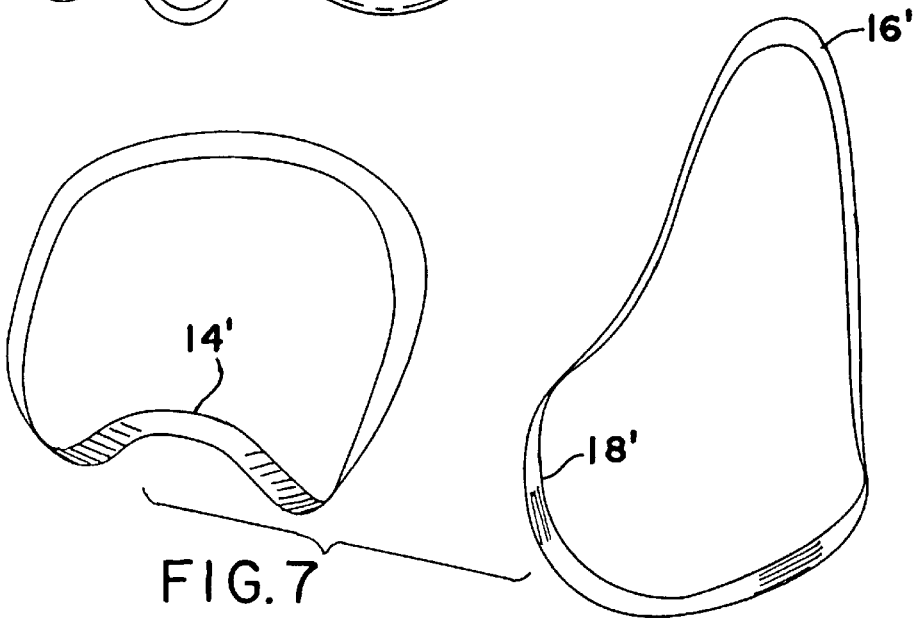
FIG. 7 is an isometric view of still another variation of my invention utilizing two independent loops of different circumferential lengths, in which the cinching means is incorporated directly into the manner in which the loops are applied in supporting position around the person, without requiring auxiliary cinching means.

FIG. 7 is an alternative design in which the cinching is built directly into the harness 10 without the need for an auxiliary cinching member or members. The two loops 14' and 18' can be separate and independent before being applied to a person. Loop 14' can be threaded over a person's raised arms, with the lower part being around the shoulder blades and the upper part being directly behind and above the neck. The loop 18' is then made to surround the chest, pass rearwardly beneath the armpits, then be threaded forwardly beneath the loop 14' so that loop 18' provides the sole support by suspension means 16'. Loops 14' is of smaller circumference than loop 18', so that it is not too far from the person's neck at the point where loop 18' passes beneath it. While there are no auxiliary cinching members such as 20 and 24 of the other embodiments, the function of cinching or gathering the loops together to keep the loops from contact with the person's face and head is felt to be within the scope of the claims. Still other forms of cinching means are believed possible.

The harness system of my invention is also capable of accepting and being connected to auxiliary supporting straps, such as a lower seat harness of the type commonly used in mountain climbing, or a waist belt surrounding the thoracic area just below the rib cage. With either of these auxiliary supports, adjustable vertical straps would extend at the user's sides between the auxiliary strap and the portion of the body harness 10 beneath the axilla. Through appropriate vertical strap adjustment, the combined harnesses could better distribute the load to different parts of the body for those persons who may not be able to be supported solely beneath the arms without considerable discomfort.

Having described my invention, I claim:

1. A harness system including a harness for at least partially supporting the weight of a person's body around the thoracic area and under the axilla:

said harness, when around the person, comprising a pair of generally continuous loops each of which is of a dimension exceeding the person's thoracic girth, the first one of said loops being adapted to horizontally engage the back side of the person's thoracic area and freely extend forwardly beneath the axilla and then around the person's shoulders to a suspension position above the person's body and generally biomechanically aligned with the person's spine and the second one of said loops being adapted to horizontally engage the front side of the person's thoracic area and freely extend beneath the person's axilla to said suspension position;

suspension means above said suspension position for enabling support of said harness from a base surface and support of the weight of the person being suspended; and means for gathering said suspension means in said suspension position, said gathering means comprising cinching means for holding portions of both loops between the suspension position and the person's body, whereby to cause the loops to encircle the person's shoulders about the armpits and to keep the harness away from the sides of the person's face.

2. A harness system according to claim 1 wherein said cinching means includes a pair of independent members, one of said members acting to cinch the free portions of the loops extending beneath and above one of said person's shoulders and the other of said members acting to cinch the free portions of the loops extending beneath and above the other of said person's shoulders.

3. A harness system according to claim 1 wherein said loops are interconnected at a point to form a unitary harness, said interconnection point coinciding essentially vertically with said suspension position when said harness is connected to a person.

4. A harness system according to claim 3 wherein said gathering means comprises cinching means for holding portions of both loops between the suspension position and the person's body, whereby to cause the loops to encircle the person's shoulders about the armpits and to keep the harness away from the sides of the person's face.

5. A harness system according to claim 4 wherein said cinching means includes a pair of independent members, one of said members acting to cinch the freely extending portions of the loops encircling one of said person's shoulders and the other of said members acting to cinch the freely extending portions of the loops encircling the other of said person's shoulders.

6. A harness system according to claim 1 wherein said gathering means comprises cinching means for holding portions of both loops between the suspension position and said person's body, said cinching means comprising a single member adapted to encompass the freely extending portions of both said loops into a single gathering point when cinching.

7. A harness system according to claim 1 wherein said loops are independent and of essentially the same circumferential dimension, whereby the free extending portions thereof can be brought together in close proximity at said suspension position for connection with said suspension means.

8. A harness system according to claim 7 wherein said gathering means comprises cinching means for holding portions of both loops between the suspension position and the person's body, said cinching means comprising a single member encompassing the freely extending portions of both said loops into a single gathering point.

9. A harness system according to claim 1 wherein said base surface includes a floor and a horizontal rail provided at a level above said person and parallel to said floor.

10. A harness system according to claim 9 wherein a walking treadmill is provided and wherein said rail and suspension position are located above said treadmill a distance enabling said person to walk on said treadmill when supported by said harness system.

11. A harness system according to claim 10 wherein said suspension means includes a hoist operable either by an assisting person alongside the harnessed person or by said harnessed person, whereby the percentage of the harnessed person's weight can be controlled by said assisting person, even to the extent of removing all physical support and utilizing said harness solely as protection against falling due to loss of balance.

12. A harness system for snug attachment to a human body, said harness system comprising a pair of generally continuous strap loops each of which loops is of a dimension exceeding the human body's girth to enable easy placement of the loops around limbs and over the body; each of said loops being adapted to engage one side of the body and extend freely beyond and around the body and beneath limbs to the other side thereof; said loops, when so extended, having loose, gatherable portions thereof on the side of the body opposite the side in engagement with the body; the improvement comprising:

a ring interconnecting said strap loops at the ends of their extended portions remote from the body; and a cinch for gathering said extended portions of said loops relatively closely to the body, said cinch being adjustably movable from a first position adjacent said ring to a second position adjacent the body for tightening said strap loops therearound.

13. The invention set forth in claim 12 wherein said cinch comprises at least one tubular member slidable along said straps of the loops between said first and second positions.

14. The invention set forth in claim 13 wherein said cinch comprises a pair of tubular members, each of which is slidable along two strap portions of both loops.

15. The invention set forth in claim 12 wherein said cinch comprises a single tubular member encompassing four strap portions of both loops.

* * * * *